United States Patent [19]

Barsky

[11] Patent Number: 4,856,655

[45] Date of Patent: Aug. 15, 1989

[54] COMBINATION BOX AND PACKAGE CUSHIONING AND METHOD

[76] Inventor: Samuel M. Barsky, 28 Charles St., Wakefield, Mass. 01880

[21] Appl. No.: 101,846

[22] Filed: Sep. 28, 1987

[51] Int. Cl.[4] ..... B65D 81/04

[52] U.S. Cl. ..... 206/524; 53/479; 493/96

[58] Field of Search ..... 206/523, 524; 53/479; 493/96, 97; 220/462, 416, 444

[56] References Cited

U.S. PATENT DOCUMENTS

| | | | |
|---|---|---|---|
| Re. 24,767 | 1/1960 | Simon et al. | 206/524 |
| 2,423,804 | 7/1947 | Waters | 493/96 |
| 3,126,144 | 3/1964 | McCulloch | 229/49 |
| 3,464,541 | 9/1969 | Papendick et al. | 220/444 |
| 3,485,347 | 12/1969 | McGill et al. | 206/524 |
| 3,841,479 | 10/1974 | Szatkowski | 220/444 |
| 4,267,927 | 5/1981 | English | 206/524 |

*Primary Examiner*—Stephen P. Garbe

*Attorney, Agent, or Firm*—William Nitkin

[57] ABSTRACT

A combination box and box cushioning having a flat box blank member with a plurality of adhesive strips positioned on the inside thereof with a planar sheet of material adhered to said flat box blank at the position of the adhesive strips which when the box is folded and set up form a plurality of pockets between the inside of the box and the sheet material which are filled with foam material to form pockets of cushioning within the box which are prearranged as to position.

14 Claims, 4 Drawing Sheets

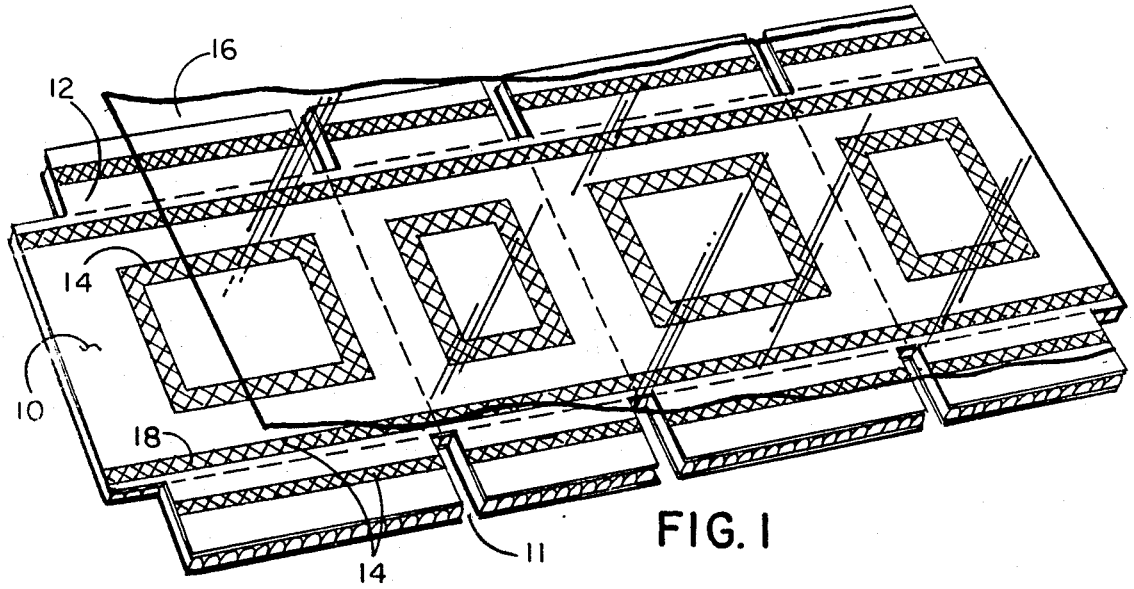
FIG. 1
FIG. 2
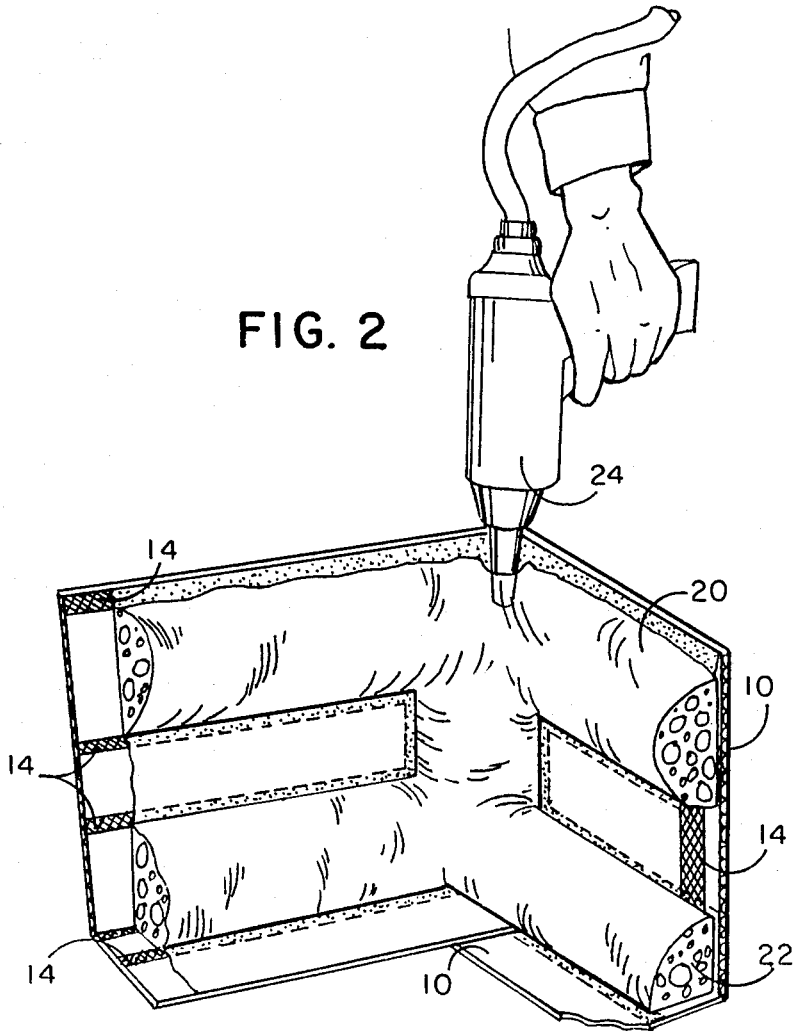

COMBINATION BOX AND PACKAGE CUSHIONING AND METHOD

BACKGROUND OF THE INVENTION

1. Field of the Invention

The present invention relates to boxes and package cushioning therein and more particularly relates to a combination box and package cushioning system.

2. Description of the Prior Art

In the prior art boxes are often shipped in stacks of flat blanks to save space in shipping and are erected and assembled at their point of use. Cushioning materials are then placed therein to help to prevent damage to the objects contained within the box. There are several methods in the prior art of providing such cushioning. For example, one method is to provide a volume of small "peanuts" of styrofoam packed around the product; another method; to wrap "bubble pack" sheet material around the object to be held in the box. A further type of cushioning product is specifically molded to fit around the object, such molded piece often made of expanded polystyrene or polyethylene foam. Yet another method utilizes expandable foam products which can be injected as a liquid by a gun into plastic bags placed in the box adjacent to the object, which liquid foams and expands the bags around the object to be cushioned. In some instances boxes are partially filled with such foam up to a preselected level which foam is then covered with a plastic film and the object is then placed thereon. Then another plastic film is placed over the object, and the remainder of the box is filled with the expanding foam. Examples of this process are found in U.S. Pat. No. 3,204,385 to Remer for Method of Packaging Articles in Foam Plastic and U.S. Pat. No. 3,190,442 to Gauss for Packaging Methods. Special foam packaging films are provided for this purpose with expanding foams injected by foam guns from component mixers to create such foams. Other types of insertable bags to be filled with foam are found in U.S. Pat. No. 3,485,347 to McGill entitled Foamed in Bags Packaging; U.S. Pat. No. 3,419,134 to Fitts entitled Foamable Package and Method for Forming Cellular Foam; and U.S. Pat. No. 3,222,843 to Schneider entitled Foam Packaging Method and Construction. In U.S. Pat. No. 3,889,743 to Presnick for Inflatable Insulation for Packing an entire bag system is disclosed to be inserted in a box after box erection. These systems, however, have the disadvantage in that the cushioning material must be individually installed in each box after setting up the box. This work is time-consuming and therefore costly to create such individual "custom" package cushioning.

SUMMARY OF THE INVENTION

It is an object of this invention to eliminate the time-consuming two-step process of the prior art of first providing a set-up box of a proper size and then, once the box is at the packaging site, to provide separate cushioning therein through the various means of the prior art by providing a combination box and package cushioning and method so that when the box is erected, it is ready for foam or other material to be injected therein as the pockets to contain the injected material are already in place in the box thereby saving much work, time and expense in forming the box cushioning.

To accomplish the objects of this invention a structure is created while the box is being manufactured, when the flat box blank is being cut and scored for future folding at the site of the packaging, a series of lines of adhesive are positioned on the inside thereof and, in one embodiment, a layer of plastic material is positioned over the adhesive lines and adhered to the box only at the position of such glue lines. When the box is erected on the site, the plastic material or equivalent forms a series of pockets which are then injected with a material such as a foam precursor which foams and expands, filling the pockets formed between the plastic material and the box by the glue seams. The system of this invention provides a tremendous advantage over the prior art because when the glue seams are properly arranged on the box, and after the box is erected, one can merely insert and inject the foam by means of foam guns which are well known in the art. When the box is erected, pockets will be formed to the exact desired shape of the cushion desired around the object to be placed in the box. In this way the arrangement of the cushioning material need not be laboriously done for each box after it is set-up and significant time and expense can be saved. The creation of the box cushioning pockets during the box manufacturing process can be done economically and the filling of the preformed pockets after the box is set up can also be accomplished using existing foam guns which are readily available and, in many cases, on site.

BRIEF DESCRIPTION OF THE DRAWINGS

FIG. 1 illustrates a perspective view of a flat box blank with glue lines and a sheet of plastic material being positioned thereover and affixed by the lines of adhesive to the flat box blank.

FIG. 2 illustrates a cutaway section of a corner of a box with the plastic material inflated by injected foam.

DESCRIPTION OF THE PREFERRED EMBODIMENT(S)

Figure 3:
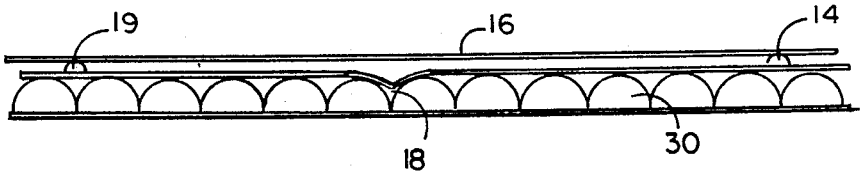
FIG. 3 illustrates a cross-sectional end view through a section of the box blank.

FIG. 1 illustrates a typical box blank 10 with slots 11 formed therein, such box blank having a plurality of horizontal and vertical score lines 18 which are lines upon which the box is folded when set up. The structure of the box is typical, and any box blank construction can be utilized in the structure and method of this invention. Along the inside of the flat box blank are a plurality of glue lines 14 which are positioned by either manually-operated or automatic glue-dispensing devices. Over the box blank is adhered a sheet of plastic-like material 16. Other materials can be utilized such as paper, cardboard or other equivalent suitable materials. The glue strips can be positioned on the box blank in a variety of positions depending upon where one wants the plastic material to be adhered to the box blank when the box is erected and the pockets filled with the foam material.

FIG. 2 illustrates a cutaway section of a corner of box 10 showing the foam injected into the pockets.

Figure 4:
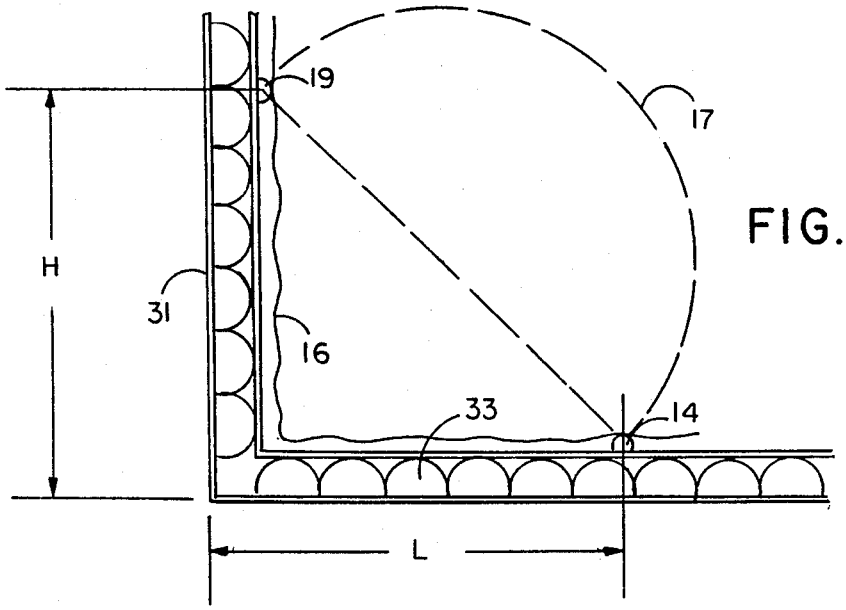
FIG. 4 illustrates the box blank of FIG. 3 erected.

FIG. 3 illustrates an end view of a portion of flat box blank 30 with score line 18 where the sides 31 and 33 of the box are to be folded at right angles to one another. Glue lines 14 and 19 are seen on end view and are disposed parallel to the score line. Adhered to glue lines 14 and 19 is plastic sheet 16 which, during the construction of the box blank, lies flat on the unfolded box across score line 18. When, as seen in FIG. 4, side 31 of box 30 is folded on score line 18 to be at a right angle to side 33 of the box, the plastic sheet which rested upon the flat box, can then rest upon the inside of each box side portion 31 and 33, extending from each glue line such as from glue line 19 to glue line 14. Since the plastic sheet is not adhered to the box 30, other than at glue lines 14 and 19, the plastic sheet is separable and movable away from the inner box surface and can extend outward therefrom as seen in the dotted lines showing the outward positioning of the plastic sheet denoted by numeral 17. Thus when the box is folded, a plurality of pockets can be formed at each corner of the erected box. The size of the cushion area formed by the plastic pocket to be filled by the foaming material is determined by the positioning of the glue lines. For example, if one took the distance in FIG. 4 from score line 18 to glue line 19, referred to as H and the distance from score line 18 to glue line 14 referred to as L, according to geometry based on an imaginary hypotenuse drawn between glue line 19 and glue line 14, the area enclosed by that hypotenuse would be $\frac{1}{2}(L \times H)$. Once the plastic sheet were expanded outward to position 17 away from the inside of box 30, the area formed would be that of a rectangle or $(L \times H)$ even though the plastic sheet may be rounded at its point of extension opposite score line 18. In this way the structure of this invention can be shipped flat but yet when the box is erected, have preformed plastic cushioning material receipt areas to be expanded outwards by the injection of foam therein to form package cushioning that is integral with the box itself and is not a separate member inserted in the box. The size of the cushioning is determined by the distance the glue lines are from the score lines. If one wanted a larger cushion, one would utilize a greater (H) and (L) distance from the score line which would create a larger cushion. If one wanted a cushion of a different configuration, for example, one which is higher than it is wide, one might move glue line 19 higher on the inside of box side 31. In this way one can predetermine from the item to be packaged the position and shape of the cushioning and then determine where the glue lines must be positioned beyond the score lines on the box to form the desired shape of the cushioning. This cushioning can continue around three-dimensional corners where a side of the box is erected adjacent to the side shown. It should be further noted though that compartments of the plastic sheeting can be formed solely upon a flat portion of the box without a scoreline enclosed in that the plastic material can be of a type adapted to expand to a known and predetermined position when the foaming material is placed therein based upon the known expansion pressure of the foaming material against the plastic. In this way, pockets can be formed on flat panels in particular shapes dependent upon the positioning of the glue lines. These shapes as well as any of the other shapes including shapes formed with glue lines disposed on either side of a score line can also be irregular and do not have to conform to straight line patterns. Irregular glue lines will yield irregular cushion shapes. In some embodiments the plastic sheet can be applied with folds such as accordian-type folds which will expand upon filling of the pocket with the foaming material. In this way pockets which must have extra depth can be formed. Such prefolded sheets can be applied the same as flat sheets during the production of the boxes while they are flat blanks as described above.

FIG. 2 illustrates a portion of a box having been folded with a portion of the sheet of plastic material 16 having foam injected therein by foam gun 24. The foam fills the areas which are not separated from one another by the glue strips which adhere the portions of the plastic such as at point 14 to the box but yet allow other portions of plastic material 16 to form filled cushion pockets 20 extending away from box 10. In this way the plastic film in the interior of the box "puffs" outward. The pockets can be filled with foam, gas or other equivalent material so as to form the cushion areas such as areas 22 causing the interior of the box to puff up and act as cushioning. As mentioned above, depending upon the shape of the product to be packaged, the glue lines can be positioned causing the pockets to puff up where one desires the packaging cushion material to be positioned and one would position the glue lines on the box in areas adjacent to where the plastic sheet should be puffed up by the foam or other material placed therein. Therefore there is no particular set area of glue line disposition. For each object, the desired cushion area would be determined and then the glue lines would be applied on the flat box blank in those areas that would cause the desired cushion pockets to form. As many box blanks with such plastic layer would be made as required.

It should be noted that foam or equivalent material can be injected in one or more positions in the interior of the box directly through plastic material 16. It can be injected at the bottom of a cushion pocket so that it rises upwards through the channels formed between the plastic and the box member. The foam also can be injected from the exterior of the box through small holes formed therein. Gas must be allowed to escape as the foam expands within the channels and small apertures can be precut in the plastic sheet. However, if gas is used as the injected material, such gas escape holes would not be utilized.

Figure 5:
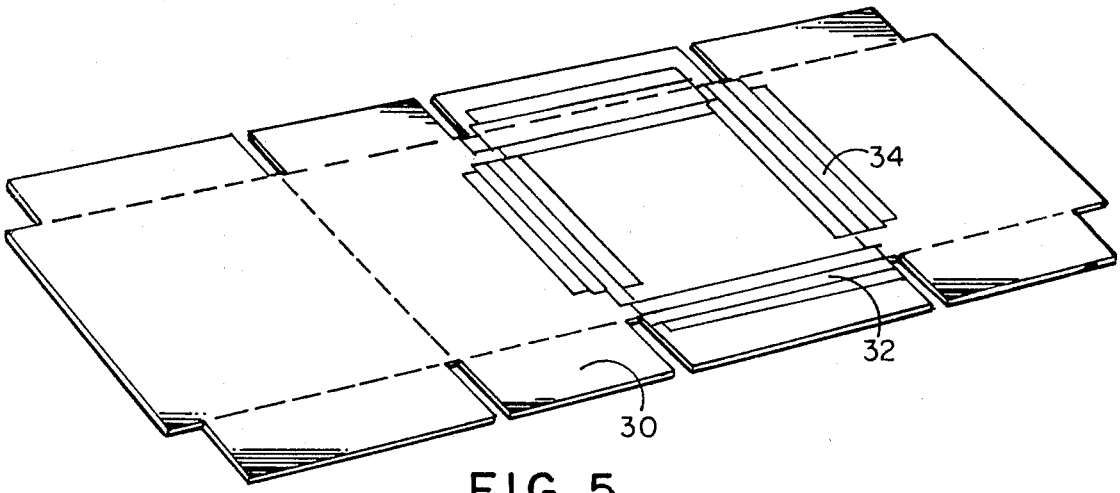
FIG. 5 illustrates an alternate embodiment of this invention wherein the plastic sheet material of FIG. 1 is replaced by cardboard members which are scored to fold in certain positions and are adhered by glue strips to the box blank.
Figure 6:
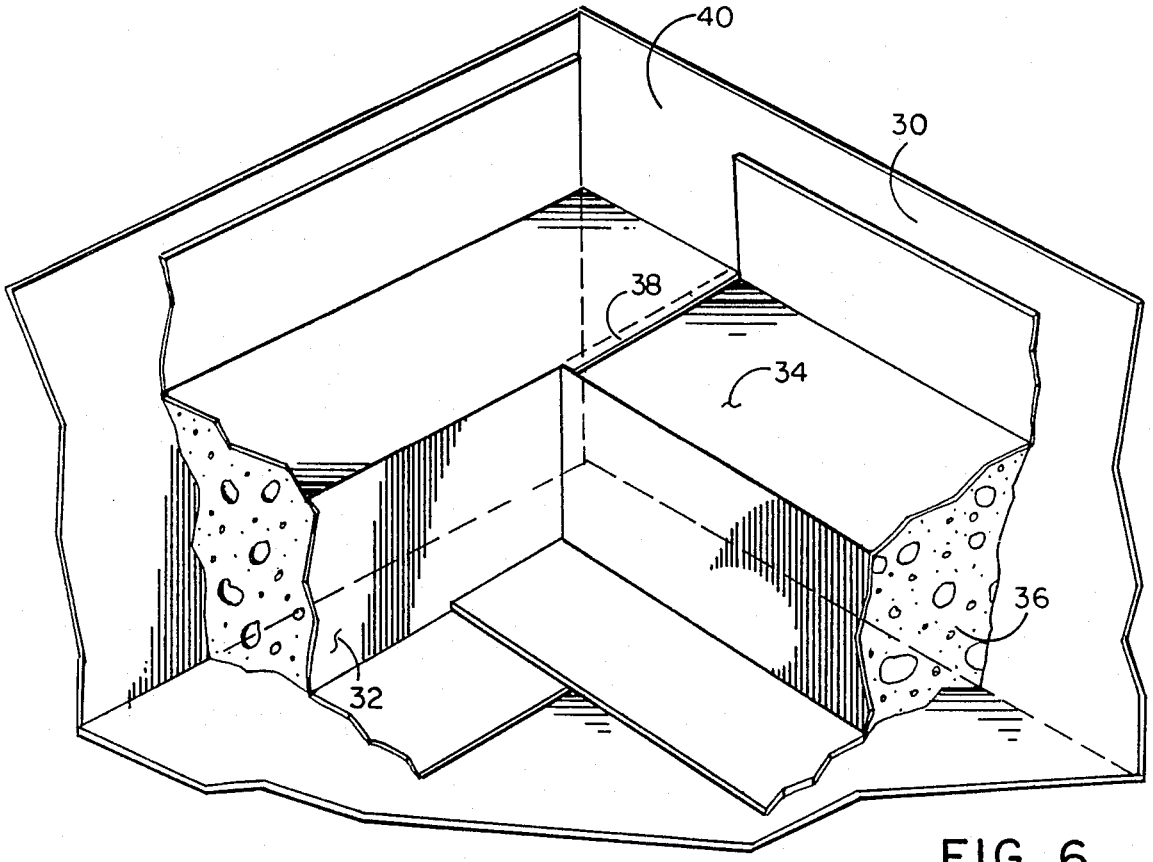
FIG. 6 illustrates the portion of the box of FIG. 5 wherein the box has been formed and the cardboard members folded along their score lines forming pockets to receive cushioning material.
Figure 7:
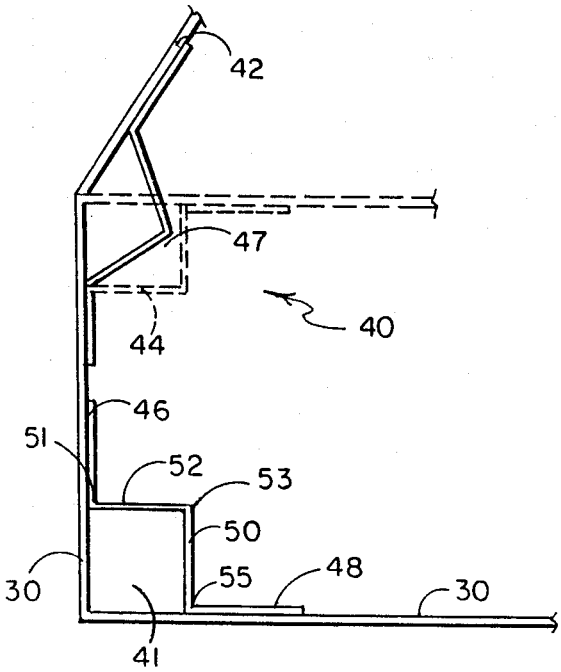
FIG. 7 illustrates a sectional side view through the box of FIG. 6 having cardboard members.

In an alternate embodiment, the plastic sheet as described above can be replaced by a plurality of sheets of stiffer material such as cardboard or equivalent as seen in FIG. 5 where box 30 has a plurality of glue strips positioned thereon and a plurality of scored stiffer cardboard members 32 are adhered thereon. Cardboard members 32 can have scoring which will bend as seen in FIG. 6 which shows a corner of box 30 erected where the cardboard elements bend outward when the box is assembled, thereby creating chamber 36 adjacent to the box itself. Chamber 36 can be filled with foam material as described above and can have openings from one chamber such as from the chamber 34 to adjacent chamber 32 through their open common meeting area 40. Cardboard member 32 can have small flap 38 which extends over a portion of chamber 34 when the box is erected to prevent the escape of the foamed material therefrom. In this way these channels can be filled with foam from one another. FIG. 7 clearly illustrates the erection of the chamber with scored member 44 at corner 40 when top 42 of box 30 is lowered causing the cardboard scored member 44 which was applied flat and glued at its ends and adapted to bend on its score lines to form the erected chamber 47. Similar structure is also seen in the lower portion of FIG. 7 showing chamber 41 which has portions 46 and 48 of cardboard member 32 adhered to box 30 and when the box is erected, side members 50 and 52 of cardboard member 32 bend on score lines 51, 53 and 55 causing open chamber 41 to form which can then be filled with cushion material as discussed above.

Figure 8:
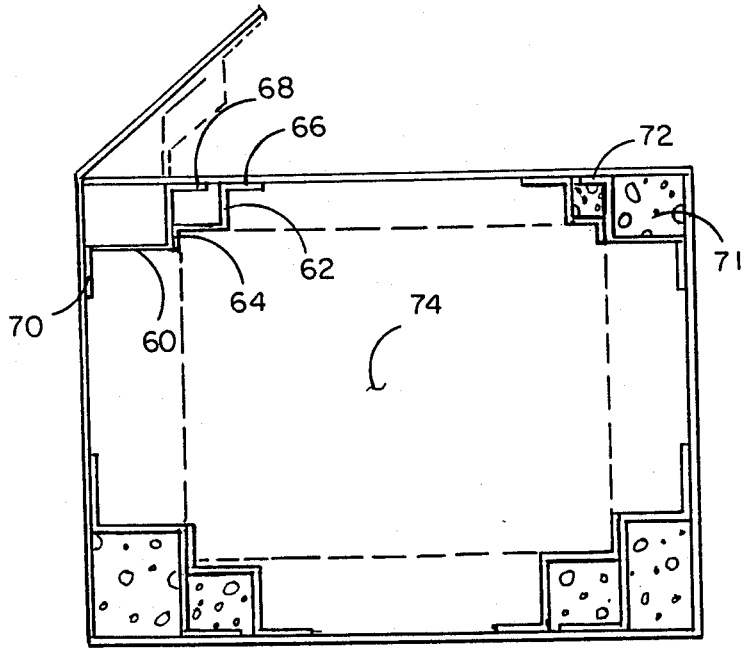
FIG. 8 illustrates a cross-sectional view through a box having overlapping cardboard layer members.

FIG. 8 illustrates an alternate embodiment of the cardboard-type folding member of FIG. 7 wherein a second layer 62 of cardboard is adhered to the box at portion 66 and to the extending portion of first cardboard member 60 at portion 64 so that when the box member is folded and cardboard member 60 extends outward as shown, cardboard member 62 also extends outward forming an adjacent pocket such as pocket 72 next to pocket 71, both of which pockets can be filled with foam. Object 75 can be placed in such box to rest against and be cradled by the shape of the thus formed pockets on each side of the box.

Figure 9:
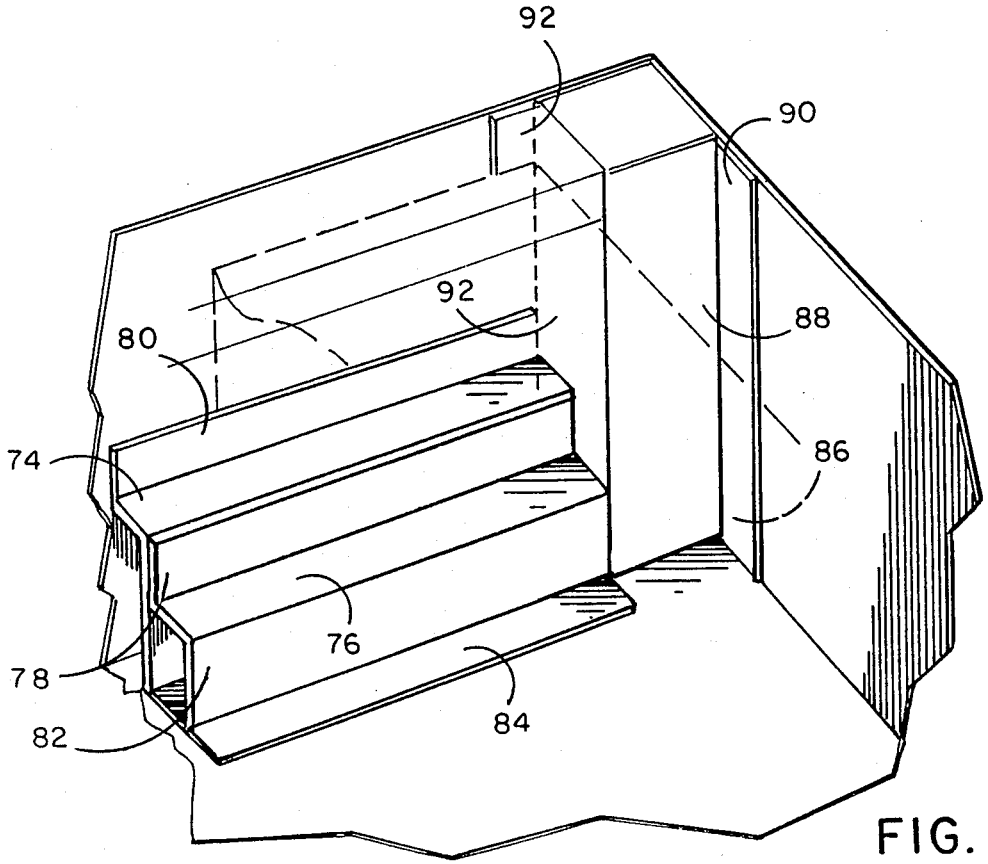
FIG. 9 illustrates a perspective view of an interior corner of the box of FIG. 8.

FIG. 9 shows a perspective view of a corner inside the box of FIG. 8. In this view the first layer is formed in a protruding fashion with portion 80 adhered to the side of the box. Horizontally disposed portion 74 of the first layer extends outward to where it bends downward which portion is overlapped by upper portion 78 of second layer 82 which is adhered to the first layer and the lower portion 84 of second layer 82 is adhered to the box base, all adapted to cushion an object such as object 86 therein. Corner cardboard member 88 can also be provided with portions 90 and 22 adhered to the box.

It should be noted that just as cardboard members can be provided in multiple layers, so can the plastic sheet embodiment which can have more than one overlaying layer of plastic sheet material to be filled with foam material to form various cushion shapes.

Although the present invention has been described with reference to particular embodiments, it will be apparent to those skilled in the art that variations and modifications can be substituted therefor without departing from the principles and spirit of the invention.

I claim:

1. An erectable and cushionable box structure comprising:

a flat box blank having an inner face and an outer face;

a plurality of fold lines disposed at selected positions on said inner face of said flat box blank;

a plurality of adhesive lines disposed at selected positions on said inner face of said flat box blank;

at least one shaped and extendable pocket of definable spatial volume adapted to be filled with a cushioning material integral with said inner face of said flat box blank, said shaped pocket comprising at least one sheet of extendable material disposed over at least a portion of said inner face and adhering to said positioned adhesive lines on said inner face, the spatial volume of said shaped pocket being extendable on demand by filling said pocket with a cushioning material; and means for introducing a cushioning material into the spatial volume of said shaped and extendable pocket.

2. The box structure as recited in claim 1 wherein the spatial volume of said shaped pocket becomes extendable by folding said inner face along said fold lines prior to filling said pocket with a cushioning material.

3. The box structure as recited in claim 1 wherein said adhesive lines are positioned adjacent to but spaced apart from said fold lines.

4. The box structure as recited in claim 1 wherein said cushioning material is introduced into said extendable pocket as a foam precursor material.

5. The box structure as recited in claim 1 wherein said sheet of extendable material is a flat sheet.

6. The box structure as recited in claim 1 wherein said sheet of extendable material is a folded sheet.

7. The box structure as recited in claim 1 further comprising first and second sheets of extendable material as a plurality of shaped and extendable pockets, said first sheet adhering to some of said positioned adhesive lines on said inner face to form a first pocket and having an adhesive area disposed on the exterior surface of said first sheet, said second sheet adhering to said adhesive area and to another positioned adhesive line on said inner face to form a second pocket adjacent to said first pocket, each of said first and second shaped pockets being adapted to be filled with a cushioning material.

8. An erected and cushioned box structure comprising:

an erected box of definable configuration and volume having a plurality of folded inner faces and outer faces;

a plurality of adhesive lines disposed at selective positions on said folded inner faces of said erected box; and at least one shaped and extended cushioning pocket of definable spatial volume filled with a cushioning material integral with said folded inner faces of said erected box, said shaped cushioning pocket comprising at least one sheet of extended material disposed over at least a portion of said folded inner faces and adhering to said positioned adhesive lines on said folded inner faces, the spatial volume of said shaped cushioning pocket having been extended by said cushioning filler material.

9. The box structure as recited in claim 8 wherein said cushioning material is a foam.

10. The box structure as recited in claim 1 or 8 wherein said sheet of material is composed of a plastic.

11. The box structure as recited in claim 1 or 8 wherein said sheet of material is composed of paper.

12. The box structure as recited in claim 8 further comprising a plurality of said shaped and extended cushioning pockets in adjacent positions.

13. A method of making an erectable and cushionable box structure comprising the steps of:

obtaining a flat box blank having an inner face and an outer face;

disposing a plurality of fold lines at selected positions on said inner face of said flat box blank;

selectively positioning a plurality of adhesive material lines on said inner face;

providing at least one shaped and extendable cushioning pocket adapted to be filled with a cushioning material integral with said inner face of said flat box blank, said shaped pocket comprising at least one sheet of extendable material disposed over at least a portion of said face and adhering to said positioned adhesive lines on said inner face, the spatial volume of said shaped pocket being extendable on demand by filling said pocket with a cushioning material; and providing means for introducing a cushioning material into the spatial volume of said shaped and extendable pocket.

14. A method for making an erected and cushioned box structure comprising the steps of:

obtaining a flat box blank having (a) an inner and outer face, (b) a plurality of fold lines disposed at selected positions on said inner face, (c) a plurality of adhesive lines disposed at selected positions on said inner face, (d) at least one shaped and extendable cushioning pocket adapted to be filled with a cushioning material integral with said inner face, said shaped pocket comprising at least one sheet of extendable material disposed over at least a portion of said inner face and adhering to said positioned adhesive lines on said inner face, the spatial volume of said shaped pocket being extendable on demand by filling said pocket with a cushioning material;

erecting said flat blank into a folded box of definable configuration and volume; and filling said shaped pockets with a cushioning material such that the spatial volume of said pockets is extended to form at least one shaped and extended cushion integral with said erected box.

* * * * *